US005618203A

United States Patent [19]

Koumatsu et al.

[11] Patent Number: 5,618,203

[45] Date of Patent: Apr. 8, 1997

[54] CONNECTOR WITH REAR HOLDER

[75] Inventors: Seiji Koumatsu; Kimihiro Abe, both of Shizuoka, Japan

[73] Assignee: Yazaki Corporation, Tokyo, Japan

[21] Appl. No.: 700,683

[22] Filed: Aug. 9, 1996

Related U.S. Application Data

[63] Continuation of Ser. No. 265,031, Jun. 24, 1994.

[30] Foreign Application Priority Data

Jun. 30, 1993 [JP] Japan ..... 5-161556

[51] Int. Cl.[6] ..... H01R 13/73

[52] U.S. Cl. ..... 439/546; 439/596

[58] Field of Search ..... 439/596, 546, 439/752, 354

[56] References Cited

U.S. PATENT DOCUMENTS

| | | | |
|---|---|---|---|
| 4,867,705 | 9/1989 | Yuasa | 439/596 |
| 4,979,913 | 12/1990 | Aiello et al. | 439/596 |
| 4,995,833 | 2/1991 | Drecker | 439/596 |
| 5,141,452 | 8/1992 | Yoneda et al. | 439/752 |
| 5,181,865 | 1/1993 | Hayes, Sr. | 439/752 |

FOREIGN PATENT DOCUMENTS

| | | | |
|---|---|---|---|
| 63-237379 | 3/1988 | Japan . | |
| 2237457 | 5/1991 | United Kingdom | 439/752 |

*Primary Examiner*—David L. Pirlot
*Assistant Examiner*—Brian J. Biggi
*Attorney, Agent, or Firm*—Finnegan, Henderson, Farabow, Garrett & Dunner, L.L.P.

[57] ABSTRACT

There is provided a connector with rear holders in which a hinge, connecting a terminal-retaining rear holder to a connector housing, is prevented from being cut, and also an accidental operation of a lock release arm of the connector housing is prevented. Terminal-retaining rear holders are pivotally connected to corresponding connector housings through hinges. A projected abutment portion for abutting against the corresponding connector housing is formed on an outer wall of each of the rear holders facing the corresponding connector housing in a full open condition of the rear holder. The projected abutment portion of the rear holder is projected in a direction of projecting of a lock release arm of the connector housing.

6 Claims, 4 Drawing Sheets

CONNECTOR WITH REAR HOLDER

This is a continuation of application Ser. No. 08/265,031, filed Jun. 24, 1994.

BACKGROUND OF THE INVENTION

The present invention relates to a connector with rear holders in which a hinge, connecting a terminal-retaining rear holder to a connector housing, is prevented from being cut, and also an accidental operation of a lock release arm of the connector housing is prevented.

FIG. 7 shows a connector with rear holders disclosed in Unexamined Japanese Patent Publication No. 63-237379.

This connector 50 with rear holders includes plate-like terminal-retaining rear holders 54 and 55 integrally formed respectively on rear ends of male and female connector housings 51 and 52 of a synthetic resin through respective thin hinges 53. After terminals 56 and 57 are inserted into the corresponding connector housings 51 and 52, the rear holders 54 and 55 are pivotally moved in a closing direction, and are held in their closed positions by engaging retaining projections 58 respectively in engagement holes 59 in the connector housings, so that the rear holders are pressed against the rear ends of the terminals 56 and 57 to retain them.

When male and female connectors 60 and 61, having the respective terminals 56 and 57 inserted therein, are fitted together, an elastic lock plate 62 provided within the female connector 61 is engaged with retaining portions 63 on the male connector 60. For disconnecting the connectors from each other, an elastic lock release arm 65 on an outer wall 64 of the male housing is pushed to flex the elastic lock plate 62, thereby releasing the locking.

However, the above conventional construction has a problem that the hinges 53 are damaged as a result of repeatedly opening the rear holders 54 and 55 excessively in directions of arrow A. There is another fear that after the connectors are fitted together, a projected manipulation portion 65*a* of the lock release arm 65 may be pushed upon interference with an external object, so that the locking is accidentally released, thus causing withdrawal of the connector.

SUMMARY OF THE INVENTION

With the above problems in view, it is an object of the present invention to provide a connector with rear holders in which a hinge will not be damaged when opening and closing the rear holder, and a lock release arm of a connector housing will not be accidentally operated after the connectors are fitted together.

The above object has been achieved by a connector with a rear holder wherein the terminal-retaining rear holder is pivotally connected to a connector housing through a hinge; a projected abutment portion for abutting against the connector housing is formed on an outer wall of the rear holder facing said connector housing in a full open condition of the rear holder; and the projected abutment portion of the rear holder is projected in a direction of projecting of a lock release arm of the connector housing.

When the rear holder is in its full open condition, the projected abutment portion is abutted against the connector housing to thereby prevent the rear holder from being excessively opened. This reduces the angle of bending of the hinge, that is, the flexing amount, thereby preventing damage to the hinge. After the connectors are fitted together, the projected abutment portion is projected in the direction of projection of the lock release arm, and is abutted against an external interfering object, thereby preventing this interfering object from being excessively pressed against the lock release arm.

DESCRIPTION OF THE PREFERRED EMBODIMENTS OF THE INVENTION

Figure 1:
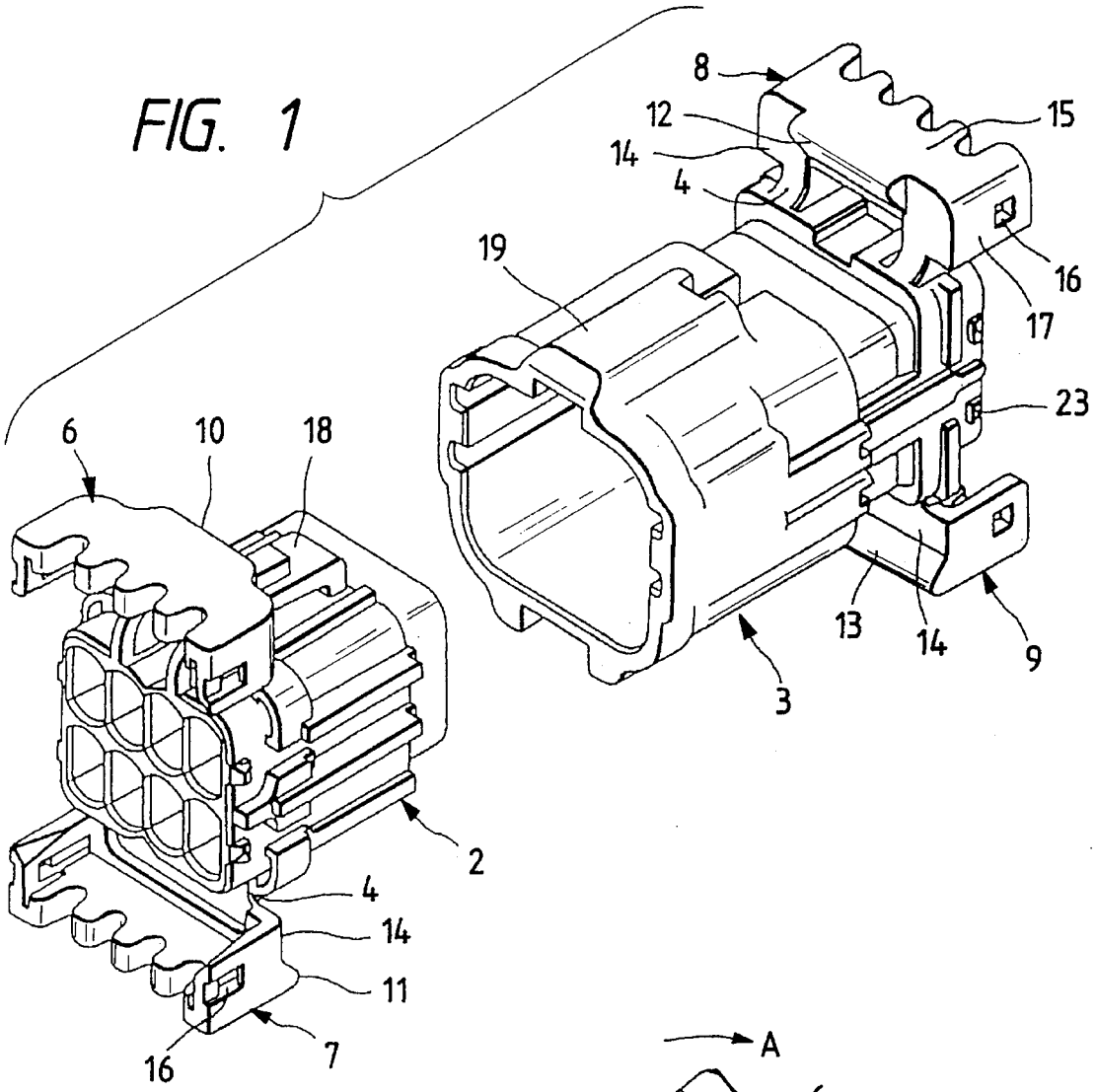
FIG. 1 is an exploded perspective view of one preferred embodiment of a connector of the present invention with rear holders.
Figure 2:
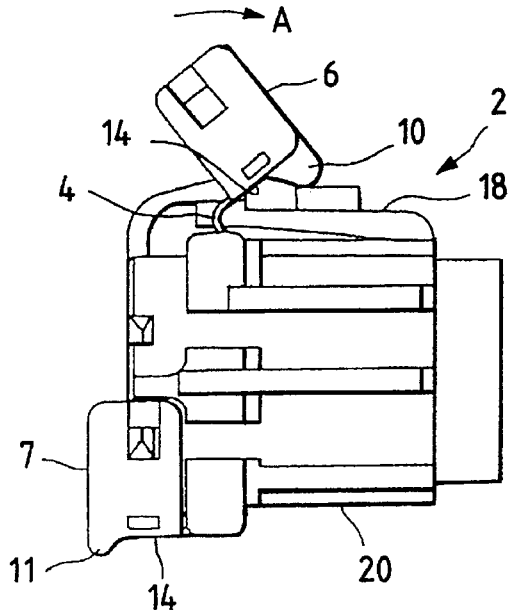
FIG. 2 is a front-elevational view showing the rear holders in their full open condition.
Figure 3:
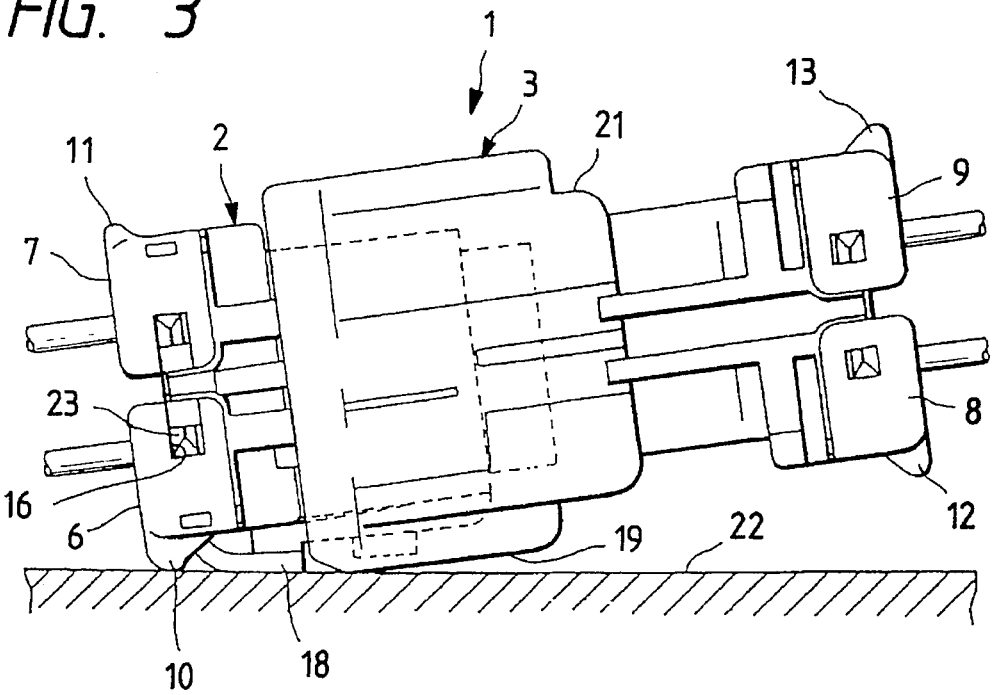
FIG. 3 is a front-elevational view showing a condition in which the connector interferes with an external interfering object after the connectors are fitted together.

FIGS. 1 to 3 show one preferred embodiment of a connector of the present invention with rear holders.

The connector 1 with rear holders is characterized in that projected abutment portions 10 to 13 for abutting respectively against outer wall surfaces of male and female connector housings 2 and 3 are formed in a projected manner respectively on two pairs of rear holders 6 to 9 which are pivotally provided respectively on rear ends of the male and female connector housings 2 and 3 through respective integral thin hinges 4.

Each of the rear holders 6 to 9 includes an outer wall 14 connected to the hinges 4, a terminal holding wall 15 extending perpendicularly from the outer wall 14, and side walls 17 each having a retaining hole 16. Each of the projected abutment portions 10 to 13 is formed on a front end portion of the outer wall 14 of the rear holder 6 to 9 facing the outer wall surface of the connector housing 2, 3 in a full open condition of the rear holder 6 to 9, each projected abutment portion being in the form of an elongate projection extending transversely of the connector.

In its full open condition, one (6) of the pair of rear holders 6 and 8 is disposed rearwardly of an elastic lock release arm 18 of the connector housing 2 in opposed relation thereto, and in its full open condition, one (8) of the pair of rear holders 8 and 9 is disposed rearwardly of an engagement hood portion 19 (which coacts with the lock release arm 18) in opposed relation thereto. When the rear holder 6 is pivotally moved in a direction of arrow A (FIG. 2), the projected abutment portion 10 on the outer wall 14 of the rear holder 6 can be abutted against the lock release arm 18, and when the rear holder 8 is similarly pivotally moved, the projected abutment portion 12 can be abutted against the engagement hood portion 19. In its full open condition, the other (7) of the pair of rear holders 6 and 7 is opposed to an outer wall surface 20 of the housing facing away from the lock release arm 18, so that the projected abutment portion 11 is abutted against the housing outer wall surface 20. In its full open condition, the other (9) of the pair of rear holders 8 and 9 is opposed to an outer wall surface 21 of the housing facing away from the engagement hood portion 19, so that the projected abutment portion 13 is abutted against the housing outer wall surface 21. Each of the projected abutment portions 10 to 13 in its full open condition is abutted against the corresponding connector housing 2, 3, so that the angle of opening of the rear holder 6 to 9 (that is, the angle of bending of the hinge) is reduced, thereby preventing the hinges 4 from being damaged.

In a full closed condition, the projected abutment portion 10 of the one rear holder 6 is projected in a direction of projecting of the lock release arm 18, as shown in FIG. 3, and therefore for example, even if an interfering object 22 such as an external panel is pressed against the lock release arm 18, the projected abutment portion 10 is abutted against the interfering object 22 to protect the lock release arm 18 disposed between this abutment portion 10 and the engagement hood portion 19 abutted against the interfering object 22. Therefore, an accidental operation (flexing operation) of the lock release arm 18 is prevented, thus eliminating the possibility of connector disconnection.

Each of the rear holders 6 to 9 is retained by engaging their respective retaining holes 16 respectively with retaining projections 23 respectively formed on the rear portions of the opposite side walls of the connector housing 2, 3.

Figure 4:
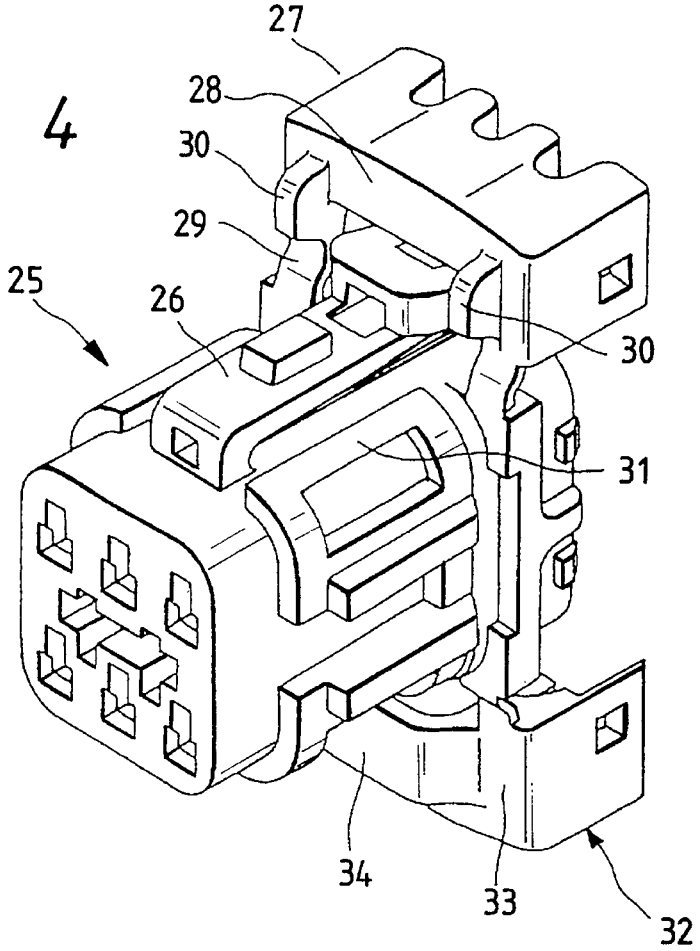
FIG. 4 is a perspective view of a modified connector (male connector) with rear holders.
Figure 5:
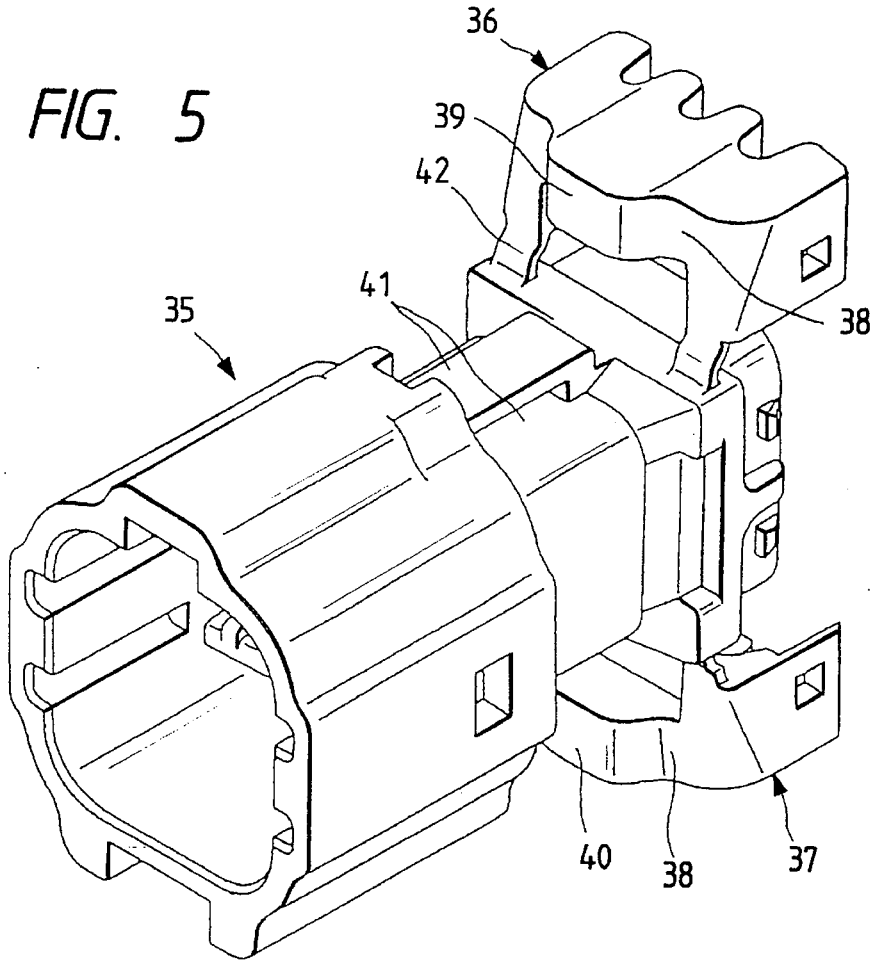
FIG. 5 is a perspective view of a modified connector (female connector)
Figure 6:
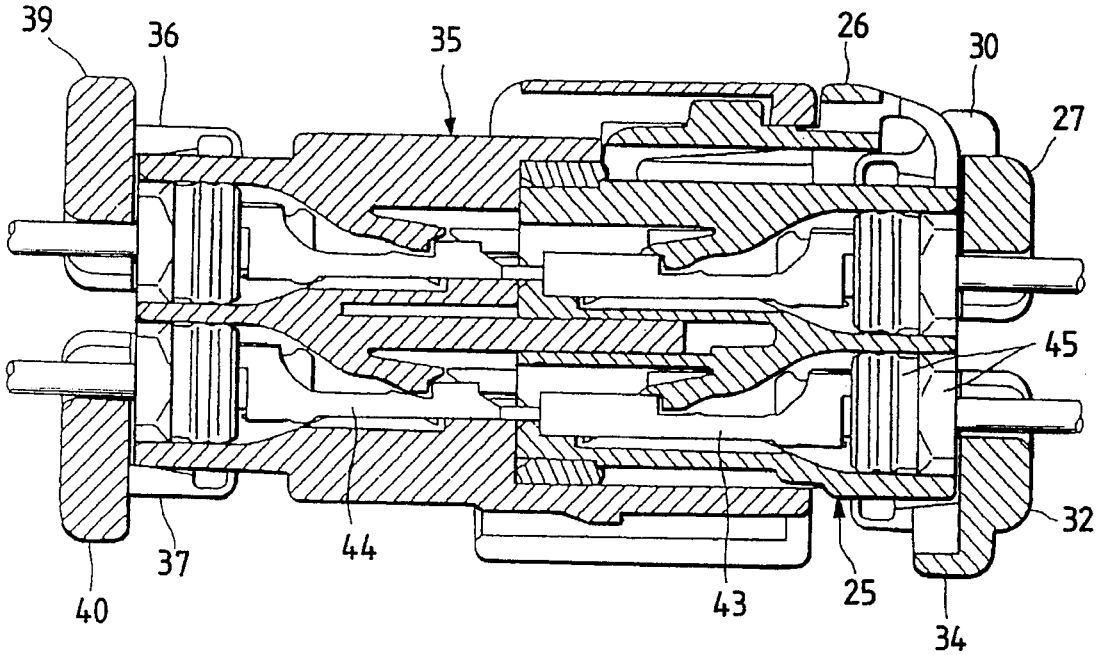
FIG. 6 is a vertical cross-sectional view showing the connector in a fitted condition.
Figure 7:
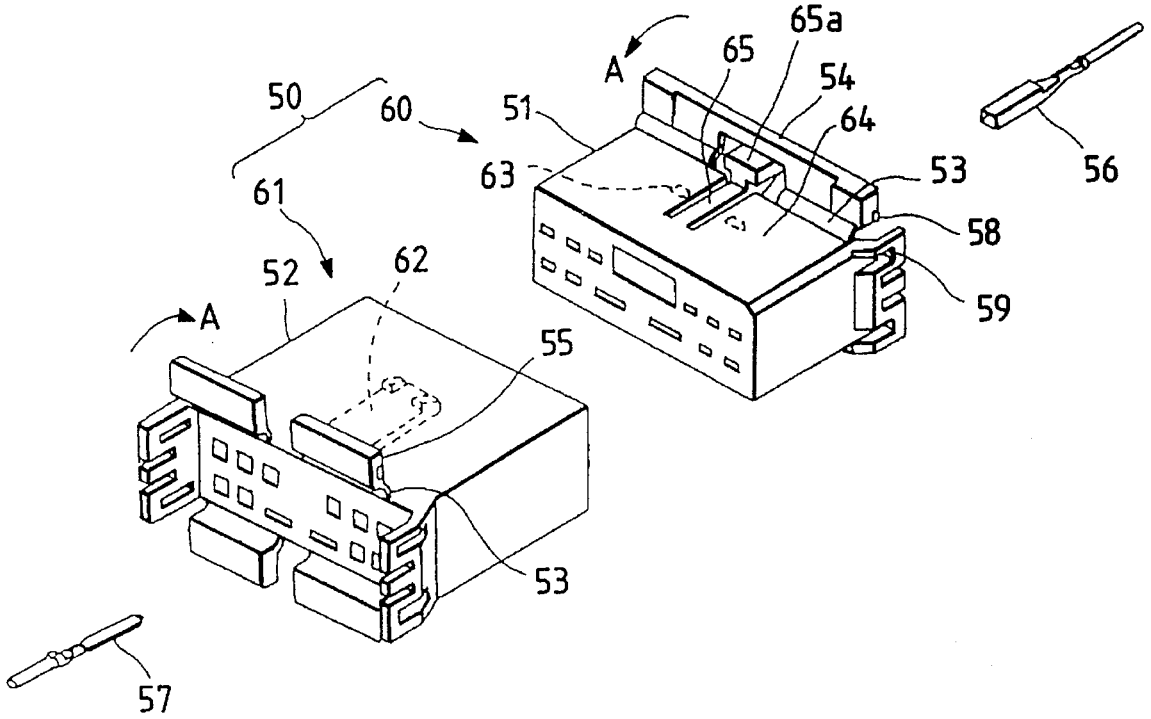
FIG. 7 PRIOR ART
FIG. 7 is an exploded perspective view of a conventional construction.

FIGS. 4 to 6 show a modification of the connector with rear holders.

In FIG. 4, a pair of projected abutment portions 30 and 30 are formed respectively on opposite side portions of a outer wall 28 of a rear holder 27 (which can face a lock release arm 26 on a male connector housing 25) in such a manner that these projected abutment portions 30 and 30 are offset with respect to the lock release arm 26, the pair of projected abutment portions 30 and 30 facing in the same direction as hinges 29 face. The pair of projected abutment portions 30 and 30 can be abutted against an outer peripheral surface 31 of the connector housing 25, thus avoiding the contact of these abutment portions with the lock release arm 26. A rear holder 32 facing away from the lock release arm 26 has a wide projected abutment portion 34 in the form of an elongate projection which is formed by outwardly bulging a central portion of an outer wall 33, the abutment portion 34 extending transversely of the connector.

In FIG. 5, a wide projected abutment portion 39, 40 is formed on an outer wall 38 of each of a pair of rear holders 36 and 37 of a female connector housing 35 in an outwardly-bulging manner, as described above for the projected abutment portion 34, the projected abutment portion 39, 40 being formed over an entire thickness of a plate having the outer wall 38. The projected abutment portions 39 and 40 can be abutted against an outer peripheral surface 41 of the female connector housing 35 to thereby prevent hinges 42 from being excessively flexed.

As shown in FIG. 6, after terminals 43 and 44 are inserted into the corresponding connector housings 25 and 35, the rear holders 36 and 37 are held in their closed position to retain the corresponding terminals 43 and 44 through respective waterproof plugs 45. The male and female connector housings 25 and 35 are fitted together in this condition. The projected abutment portions 30, 34, 39 and 40 of the rear holders 27, 32, 36 and 37 are projected outwardly beyond the outer surfaces of the connector housings 25 and 35 to thereby prevent the lock release arm 26 from interfering with an external object. Furthermore, when the connectors are to be disconnected from each other, the projected abutment portions 30, 34, 39 and 40 serve as finger holder portions, so that the connector disconnection operation can be effected easily.

As described above, in the present invention, the projected abutment portion of each rear holder can be abutted against the connector housing to prevent the rear holder from being opened excessively, and therefore damage to the hinges is eliminated, so that the rear holder can always be opened and closed in a stable manner. Moreover, after the connectors are fitted together, the projected abutment portions prevent the lock release arm from being pushed by an external interfering object, and therefore an accidental operation of the lock release arm is eliminated, thereby preventing the disconnection of the connector. Furthermore, since the projected abutment portions also serve as the finger holder portions when disconnecting the connector, the efficiency of the connector disconnecting operation is enhanced.

What is claimed is:

1. A connector with a rear holder, comprising:

a connector housing having an unobstructed outer surface and a rear end generally perpendicular to the outer housing surface;

a rear holder having an outer wall pivotally connected to said connector housing by a hinge, the outer wall of the rear holder having a length from the hinge less than that of the unobstructed outer surface from the hinge, said rear holder having a terminal holding wall extending perpendicularly from said outer wall to close on the rear end of the housing upon pivotal movement of the rear holder from an open position to a closed position; and a projected abutment portion formed on the outer wall of the rear holder, the abutment portion extending from the outer wall in a generally perpendicular direction opposite from the terminal holding wall to engage the unobstructed outer housing surface and restrict movement of the rear holder from the closed position to a limited open position.

2. The connector with a rear holder according to claim 1, wherein the abutment portion is an elongate projection extending transversely of the connector.

3. The connector with a rear holder according to claim 1, wherein the rear holder includes a side wall perpendicular to both the terminal holding wall and the outer wall, the side wall having a retaining hole to secure the rear holder in the closed position.

4. The connector with a rear holder according to claim 3, wherein said connector housing includes a side housing wall having a retaining projection to engage the retaining hole.

5. The connector with a rear holder according to claim 1, wherein said connector housing includes an elastic lock release arm movable into the housing to a release condition, the projected abutment portion abutting against and moving the lock release in the limited open position of said rear holder.

6. The connector with a rear holder according to claim 1, wherein said connector housing includes an elastic lock release arm movable into the housing to a release condition, the projected abutment portion comprising a pair of spaced projections offset with respect to said lock release arm so as to abut against an outer peripheral surface of said connector housing and avoid contact with the lock release arm, in the limited open condition of said rear holder.

* * * * *